US006419518B1

(12) United States Patent
Dittman

(10) Patent No.: US 6,419,518 B1
(45) Date of Patent: Jul. 16, 2002

(54) INSULATION DISPLACEMENT CONTACT FOR USE WITH FINE WIRES

(75) Inventor: Larry E. Dittman, Middletown, PA (US)

(73) Assignee: Y-connect, Incorporated, Middletown, PA (US)

( * ) Notice: Subject to any disclaimer, the term of this patent is extended or adjusted under 35 U.S.C. 154(b) by 0 days.

(21) Appl. No.: 09/784,939

(22) Filed: Feb. 16, 2001

(51) Int. Cl.[7] ..... H01R 4/24
(52) U.S. Cl. ..... 439/401; 439/395
(58) Field of Search ..... 439/395, 399, 439/400, 401

(56) References Cited

U.S. PATENT DOCUMENTS

| | | | | |
|---|---|---|---|---|
| 3,845,455 A | * | 10/1974 | Shoemaker | 439/401 |
| 4,136,920 A | | 1/1979 | Scholtholt et al. | 339/98 |
| 4,293,177 A | | 10/1981 | Weisenburger | 339/99 |
| 4,600,259 A | | 7/1986 | Olsson | 339/99 |
| 4,662,699 A | | 5/1987 | Vachhani et al. | 339/97 |
| 4,722,699 A | | 2/1988 | Heng et al. | 439/396 |
| 4,897,040 A | * | 1/1990 | Gerke et al. | 439/401 |
| 4,902,241 A | | 2/1990 | Lockard | 439/395 |
| 4,921,436 A | | 5/1990 | Sole et al. | 439/395 |
| 4,932,891 A | | 6/1990 | Spanke et al. | 439/395 |
| 4,975,077 A | | 12/1990 | Kato et al. | 439/395 |
| 5,282,758 A | | 2/1994 | Onoue | 439/395 |
| 5,492,484 A | | 2/1996 | Archer | 439/395 |
| 5,554,048 A | | 9/1996 | Martins | 439/406 |
| 5,588,859 A | | 12/1996 | Maurice | 439/290 |
| 5,616,047 A | | 4/1997 | Lutsch | 439/397 |
| 5,836,782 A | | 11/1998 | Odley et al. | 439/397 |
| 5,879,205 A | * | 3/1999 | Egenolf et al. | 439/852 |

* cited by examiner

*Primary Examiner*—Tho D. Ta
*Assistant Examiner*—Ann McCamey
(74) *Attorney, Agent, or Firm*—Barley, Snyder, Senft & Cohen, LLC

(57) ABSTRACT

An electrical contact in which the thickness of the stock material is greater than the width of an insulation displacement slot provided therein. The contact is manufactured utilizing conventional stamping and forming operations to create an insulation displacement slot which could not be previously manufactured using these techniques. The contact has a wire receiving section and a mounting section integrally attached to the wire receiving section. An insulation displacement plate is provided on the wire receiving section, the insulation displacement plate has a first portion and a second portion which are positioned proximate each other to form the insulation displacement plate. A first slot portion stamped from the first portion edge and a second slot portion stamped from the second portion edge are positioned to form an insulation displacement slot, whereby the width of the insulation displacement slot can be dimensioned to receive and terminate the fine wires therein.

15 Claims, 5 Drawing Sheets

INSULATION DISPLACEMENT CONTACT FOR USE WITH FINE WIRES

FIELD OF THE INVENTION

The invention relates to a contact which utilizes insulation displacement technology. In particular, the invention is directed to the use of insulation displacement technology with fine wires.

BACKGROUND OF THE INVENTION

The use of insulation displacement contacts (IDC) technology is well known in the electrical connector industry. In general, a slot is provided in a contact which cooperates and terminates a respective wire. As the wire is moved into engagement with the slot, the edges of the slot cut through the insulation provided on the wire. The width of the slot is less than the width of the conducting core of the conductors so that as the conductor moves into the slot the edges of the slot contact the conductor to form the electrical contact therebetween.

Terminals of this type are well known in the industry and are widely used for wires having diameter of at least 0.33 millimeters (which is the equivalent of an AWG 28 WIRE), but they are not used to any significant extent for wires having a diameter of less than 0.33 millimeters. The reason that insulation displacement technology is not used for fine wires is that it is impractical to produce terminals having extremely narrow slots. Consequently, as narrow slots are difficult to produce, the electrical connection between the terminals and fine wires is not assured. For example, the slot required for a wire having a diameter of about 0.2 millimeters must have a width of about 0.1 millimeter. Utilizing conventional die and punch technology, this size slot is extremely difficult to manufacture.

The wire-receiving slots are produced in the sheet metal from which the terminals are manufactured by means of conventional punch and die techniques. In other words, a punch is provided having a width equal to the width of the slot and a die is provided having an opening into which the punch moves. The sheet metal is supported on the die; and when the punch moves into the die, the slot is formed. As a practical matter, it is not possible to produce slots in sheet metal of a given thickness which have a width which is significantly less than the thickness of the sheet metal. In particular, a slot having a width which is less than half the thickness of the stock material is difficult to manufacture. Consequently, if the stock metal has a thickness of about 0.30 millimeters, it is impractical to punch a slot in the stock metal having a width which is 0.15 millimeters. If a wire has a diameter of 0.20 millimeters, the slot width should be approximately 0.10 millimeters. As previously stated, a slot having this width cannot be produced in stock metal having a thickness of 0.30 millimeters. This limitation on slot width exists because the narrow punch will break because of the extremely high stresses imposed on the punch when it moves against the stock metal. Alternatively, if the punch does not break, the high wear on the punch and the die will cause the edge of the slot to be deformed, thereby providing ineffective electrical connection between the conducting core of the wire and the electrical terminal.

It might appear that the terminals for extremely fine wires might be produced from extremely thin stock metal which would permit the formation of extremely narrow slots in the stock metal. However, if the stock metal used for the terminals is extremely thin, the resulting terminals will be flimsy and will be useless for that reason. In other words, if extremely thin stock is used, when the wire is moved into engagement with the slot, the thin metal sock will be deformed and the insulation of the conductor will not be displaced. As the insulation is not removed properly and as the width of the slot is not properly controlled, the conducting core of the wire will not be placed in electrical connection with the electrical terminal.

U.S. Pat. No. 4,600,259 discloses a contact for use with fine wire. The miniature electrical contacts are provided with closely-spaced thin plates which define there between lengthy passageways for receiving closely-spaced conductors of a wire or cable. Zones around the contact surface sections are coined to reduce their thickness such that the contact surface sections will engage and terminate the wire. This allows fine wires to be terminated such that the conducting cores are provided in electrical engagement with the electrical contacts.

The present invention is directed to the achievement of an approved terminal which is relatively inexpensive to manufacture and which provides the required integrity of the electrical contact to insure that an electrical connection will be made between the core conductors of the fine wire and the electrical contact. The electrical contact of the present invention is stamped and formed using conventional stamping technology and is then folded over to provide a slot with the width appropriate to terminate fine wires.

SUMMARY OF THE INVENTION

The invention is directed to an electrical contact for terminating fine wires thereto. In other words, the invention is directed to an electrical contact in which the thickness of the stock material is greater than the width of an insulation displacement slot provided therein. The contact is manufactured utilizing conventional stamping and forming operations to create an insulation displacement slot which could not be previously manufactured using these techniques. Consequently, the invention eliminates the need to manufacture narrow slots by means of lasers and the like In particular the invention is directed to an electrical contact for terminating fine wire. The contact has a wire receiving section and a mounting section integrally attached to the wire receiving section. An insulation displacement plate is provided on the wire receiving section, the insulation displacement plate has a first portion and a second portion which are positioned proximate each other to form the insulation displacement plate. A locking member is provided on the first portion and cooperates with the second portion to maintain a first portion edge of the first portion adjacent to a second portion edge of the second portion. A first slot portion stamped from the first portion edge and a second slot portion stamped from the second portion edge are positioned to form an insulation displacement slot, whereby the width of the insulation displacement slot can be dimensioned to receive and terminate the fine wires therein.

Curved bight portions are integrally attached to either end of the insulation displacement plates and the strain relief plates. The bight portions connect the plates together and maintain the spacing therebetween.

The invention is also directed to a method of manufacturing the electrical contact to terminate fine wire. A blank of material is stamped using conventional punch and die techniques to provide a first slot portion at a first free end and a second slot portion at an oppositely facing second free end. A first portion with the first free end provided thereon and a second portion with the second free end thereon are then bent or formed such that the fist free end and the second free end are positioned adjacent each other. In this position, the first slot portion and the second slot portion cooperate to form an insulation displacement slot which has a width which is less than the thickness of the material. The punch and die used to make the first slot portion and the second slot portion have a width which is greater than the width of the insulation displacement slot made from the first slot portion and the second slot portion.

DETAILED DESCRIPTION OF THE INVENTION

With more particular reference to the drawings, the invention is directed to an electrical contact 2 which can be provided in a housing, mounted to a printed circuit board, or used in any other conventional manner. As the manner in which the contact is mounted or captured is not important with respect to the invention described and claimed herein, the particular housing, etc. in which the contact is mounted will not be described.

Figure 1:
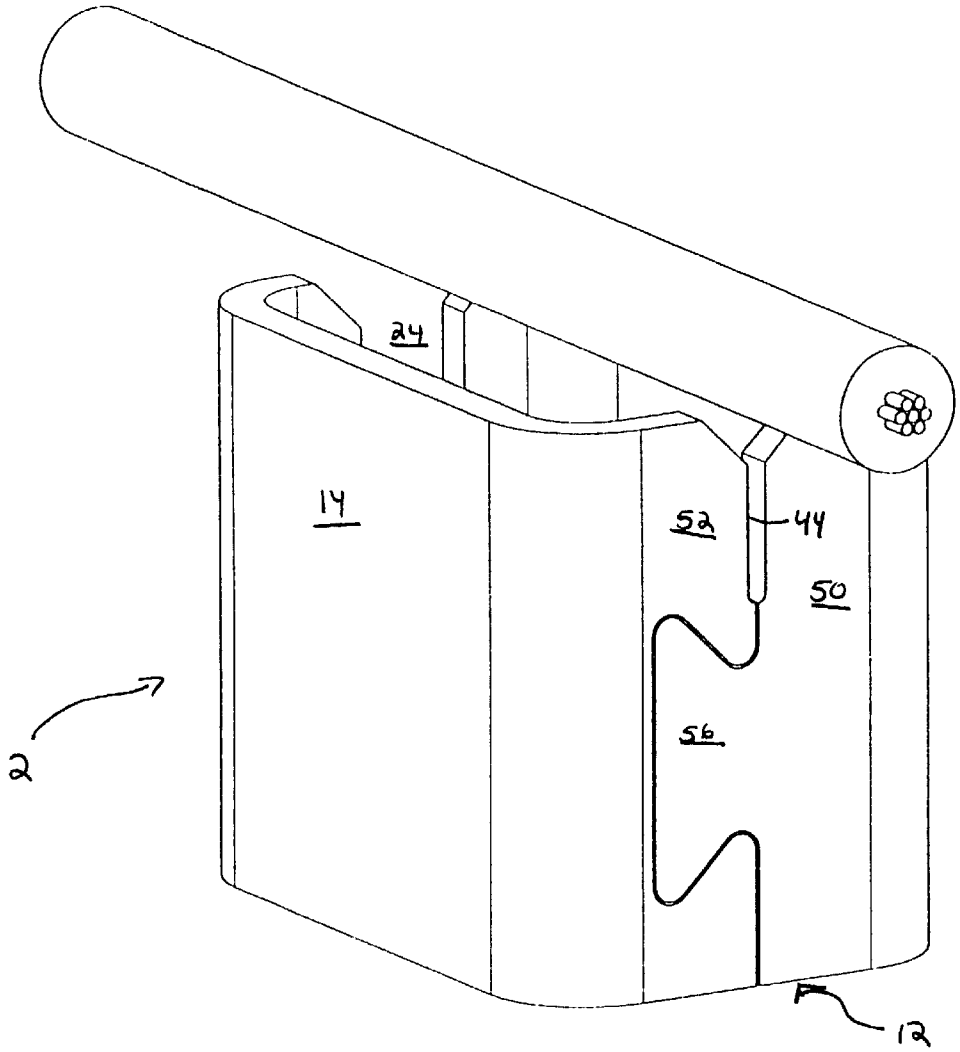
FIG. 1 is an enlarged perspective view of an electrical contact according to the present invention.

Referring to FIG. 1, in the embodiment shown electrical contact 2 is of one piece construction and is stamped and formed from 0.10-inch thick stock. The particular dimension of the stock material can vary and still remain within the scope of the invention. The material used can be a copper-nickel-tin alloy or other such alloys having the strength and electrical characteristics required. Each contact 2 has an wire receiving section 4 and a mounting section 6. In the embodiment shown in the figures, the mounting section 6 is a post which can be soldered to a through-hole in a printed circuit board. However, the mounting section can have various configurations depending on the particular application in which the contact is used.

Referring to FIGS. 1 through 4, the wire receiving section 4 has a back or strain relief plate 10 and a front or insulation displacement plate 12. The front plate 12 and back pate 10 are essentially parallel to each other and are connected by curved integral bights 14 at either end thereof.

The back plate 10 has a free end 20 and an integral end 22. The integral end 22 is integrally attached to the mounting section 6. The mounting section 6 extends from the integral end 22 in a direction away from the free end 20. A strain-relief slot 24 is provided on the back plate 10 and extends from the free end 20 in a direction toward the integral end 22. The strain-relief slot 24 is positioned approximately midway between bights 14. The width $W_S$ of the slot can vary according to the size of the wire to be terminated in the wire receiving section 4. The width $W_S$ is dimensioned to cooperate and grip with the insulation of the wire, such that when a force is exerted on the wire, the force will be absorbed by the back plate 10. In other words, the width $W_S$ is of a large enough dimension to allow the strain-relief slot 24 to be stamped from the stock material in the conventional manner, i.e. the width $W_S$ is greater than half of the thickness of the stock material.

Figure 2:
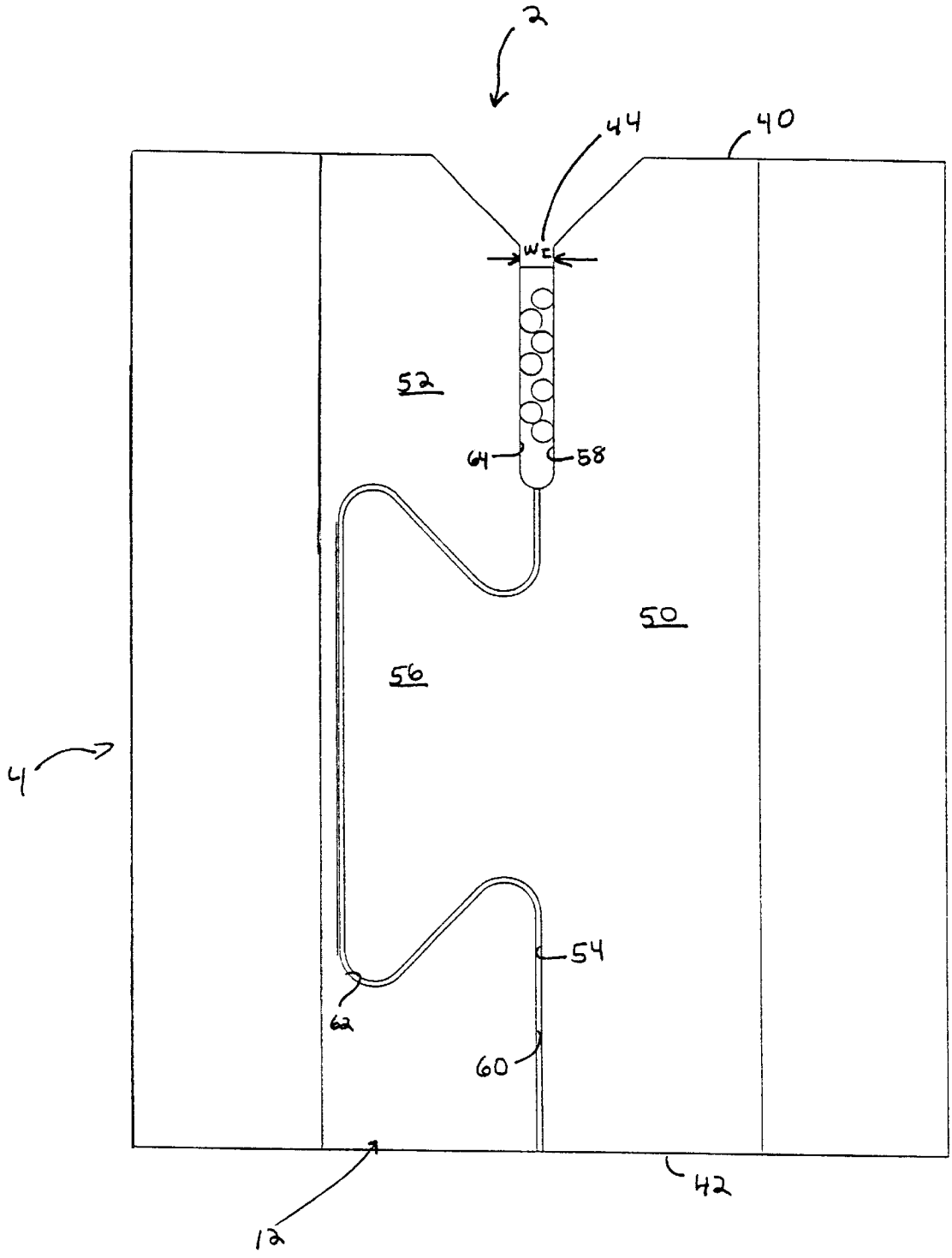
FIG. 2 is a partial enlarged front view of the electrical contact of FIG. 1 showing the wire receiving section of the contact with a cross-sectional wire inserted therein.
Figure 3:
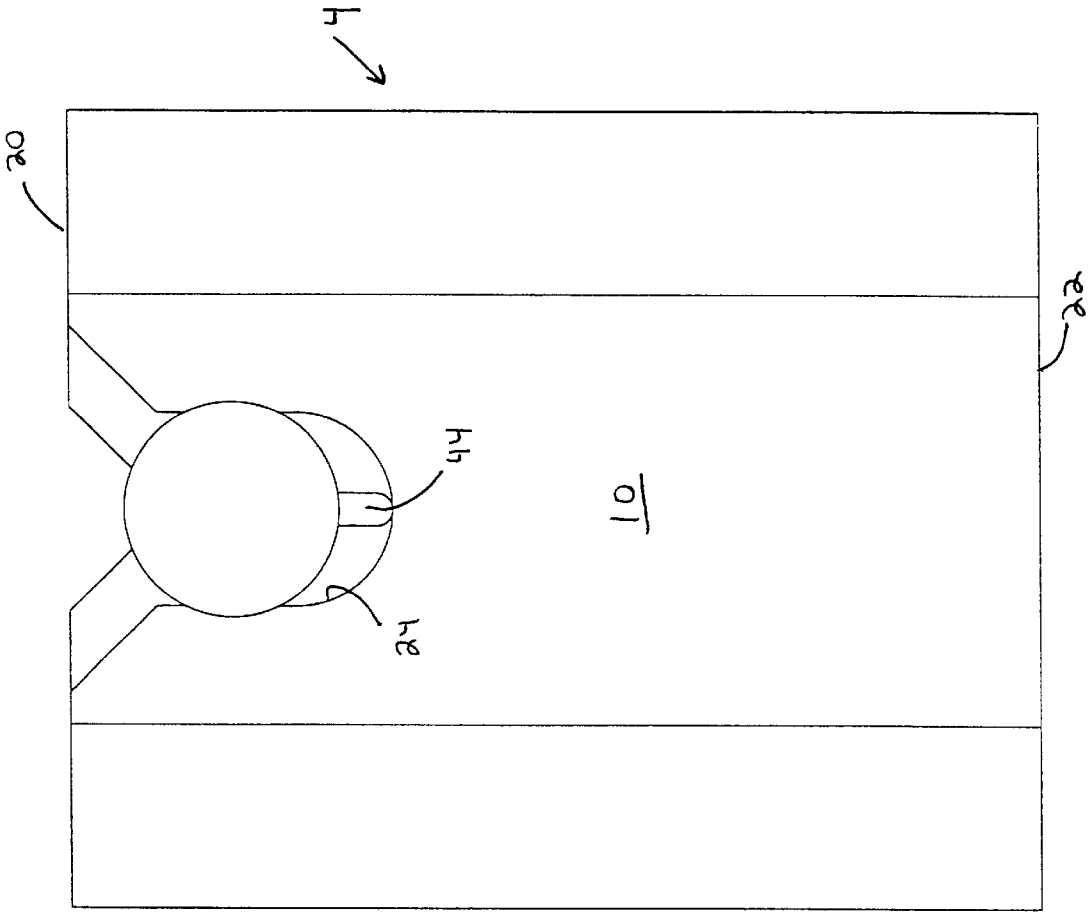
FIG. 3 is a partial enlarged rear view of the electrical contact of FIG. 1 showing the wire receiving section of the contact with a cross-sectional wire inserted therein.
Figure 4:
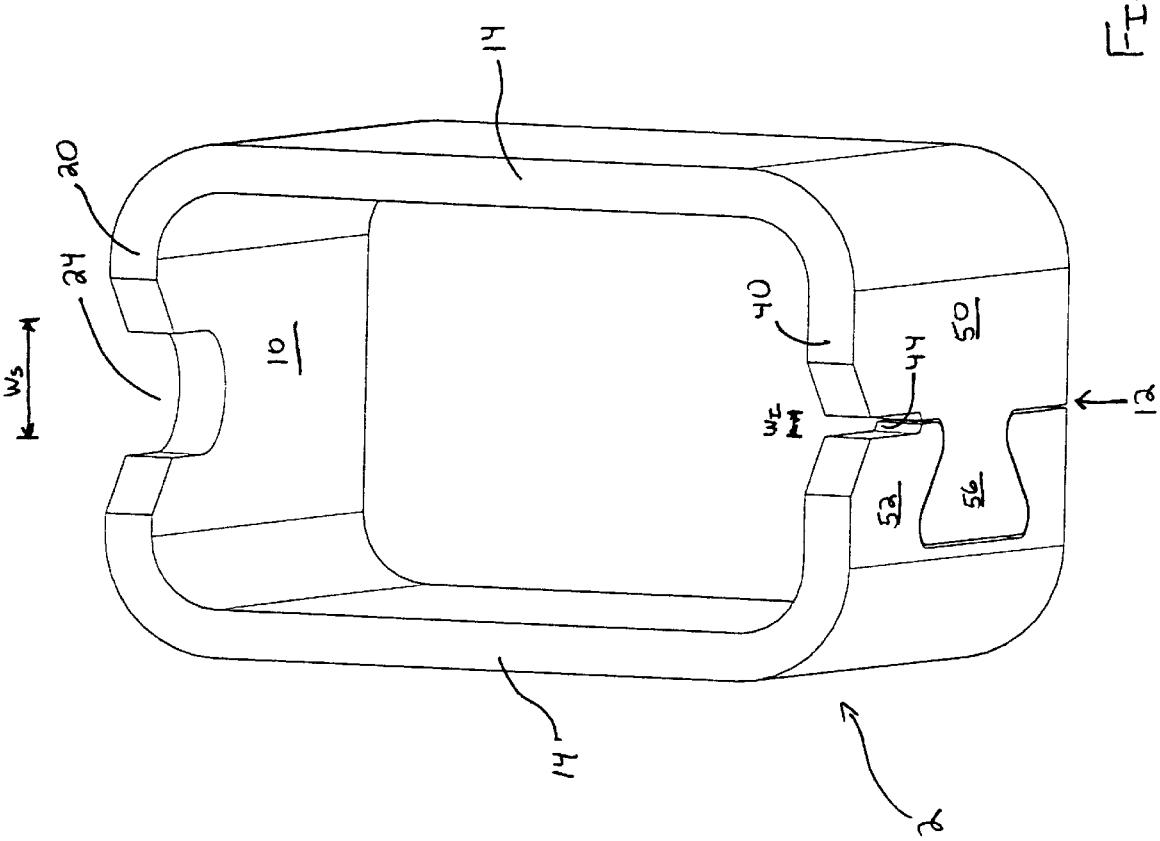
FIG. 4 is an enlarged top view of the electrical contact of FIG. 1 with no wire inserted therein.

The front plate 12, as best shown in FIG. 2, has an upper free end 40 and a lower free end 42. The upper free end 40 is positioned in essentially the same plane a free end 20 of back plane 10. An insulation displacement slot 44 is provided in the front plate 12 and extends from the upper free end 40 in a direction toward the lower free end 42. The insulation displacement slot 44 is positioned approximately midway between bights 14 and in line with strain-relief slot 24. The insulation displacement slot 44 has a width $W_I$ of approximately 0.02 inches. The width $W_I$ of the slot can vary according to the size of the wire to be terminated in the wire receiving section 4. The width $W_I$ is dimensioned to pierce the insulation of the wire and allow the core conductor to electrically engage the front plate 12. When fine wires (having an effective diameter of 0.04 inches or less) are terminated in this manner, the width $W_I$ of the insulation displacement slot 44 must be small enough to engage the core conductor of the wire. Due to the required size for termination, the width $W_I$ is less than half of the thickness of the stock material. As is discussed in the background, when a slot having a width which is less than half of the thickness of the stock material, conventional stamping technology cannot be used to create the slot.

Figure 5:
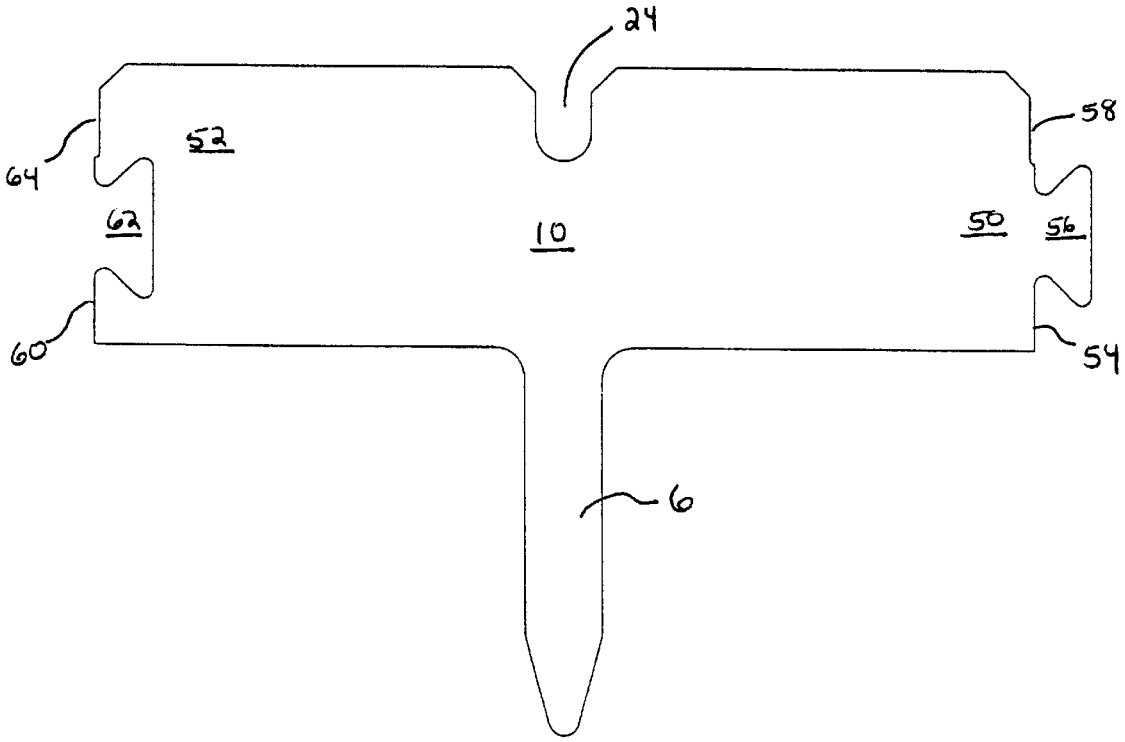
FIG. 5 is a plan view of the blank of the electrical contact of FIG. 1 after it has been stamped, but prior to it being formed.

Referring to FIG. 5, the method of stamping and forming the contact 2 according to the invention is represented. The stock material is stamped in a flat blank as shown in FIG. 5. Back plate 10 and strain-relief slot 24 are shown and extend from mounting section 6. Extending from either side of back plate 10 are the bight portions 14 before the bights are formed into the configuration shown in FIGS. 1 through 4.

A first and second portion 50, 52 extend from respective bights portions in a direction away from back plate 10. First portion 50 has a free edge 54 with a locking projection 56 extending therefrom. In the embodiment shown, the projection 56 has a trapezoidal configuration, but many other configurations of the locking projection can be provided without departing from the scope of the invention. A first slot portion 58 is stamped and removed from the free edge 54. The first slot portion 58 extends from the upper free end 40 toward the lower free end 42. The first slot portion 58 has an edge which has a straight portion and an arcuate portion.

Second portion 52 has a free edge 60 with a locking recess 62 extending from the free edge 60 in a direction toward strain-relief slot 24, when viewed in FIG. 5. The locking recess 62 is configured to conform to the shape of the locking projection 56 and allow the locking projection 56 to be retained therein, as will be more fully discussed below. A second slot portion 64 is stamped and removed from the free edge 60. The second slot portion 64 extends from the upper free end 40 toward the lower free end 42. The second slot portion 64 has an edge which has a straight portion and an arcuate portion.

After the stock is stamped into the shape of the blank shown in FIG. 5, the blank is formed into the shape shown in FIGS. 1 through 5. In so doing, the bights 14 are bent into a U-shaped configuration. With bights 14 bent, first and second portions 50, 52 are positioned to be essentially parallel to back plate 10. In this position, free edge 54 of first portion 50 and free edge 60 of second portion 52 are positioned proximate each other, with locking projection 56 positioned in locking recess 62. First and second portions 50, 52 together comprise front plate 12. First slot portion 58 and second slot portion 64 combine to form insulation displacement slot 44. As the insulation displacement slot 44 is made from first and second portions 50, 52, the insulation displacement slot 44 is not stamped in the conventional manner. This allows the insulation displacement slot to be manufactured having a width which is less than the thickness of the stock material, thereby allowing fine wires to be terminated thereto. It is important to note that conventional stamp and die techniques can be used to produce the first and second portions 50, 52. As these portions are stamped from the edge of the blank, the punch and die used to make the portions can be significantly larger than the material removed. Therefore, the width of the punch is greater than half of the thickness of the material, and conventional stamping techniques apply. The fact that only a small amount of material is removed is because the punch and die are offset from the edge of the material.

With the contact stamped and formed according to the above description, a fine wire is brought into engagement with the wire receiving section 4 of the contact 2. As the wire is inserted into the insulation displacement slot 44, the wire will exert pressure on the edges of the slot, thereby causing the first portion 50 and second portion 52 to move in a direction away from each other. However, as locking projection 56 is captured in locking recess 62, the movement of the first portion 50 away from the second portion 52 is prevented and the integrity of the insulation displacement slot 44 is maintained.

The invention as described herein allows fine wires to be terminated utilizing insulation displacement technology. The configuration of the contact allows the contact to be manufactured using conventional stamping technology, thereby eliminating the need for expensive, high technology solutions such as laser cutting and the like.

The foregoing illustrates just some of the alternatives for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical contact for terminating fine wire, the contact comprising:

a wire receiving section and a mounting section integrally attached to the wire receiving section;

an insulation displacement plate provided on the wire receiving section, a first portion and a second portion are positioned proximate each other to form the insulation displacement plate, a locking member provided on the first portion and cooperates with a locking member on the second portion to maintain a first portion edge of the first portion adjacent to a second portion edge of the second portion;

a first slot portion stamped from the first portion edge and a second slot portion stamped from the second portion edge, the first slot portion and the second slot portion are positioned to form an insulation displacement slot, the locking members positioned proximate a base of the first and second slot portions;

whereby the width of the insulation slot receives and terminates fine wires therein and the locking members maintain the width as the fine wires are received and terminated therein.

2. An electrical contact as recited in claim 1 wherein the mounting section extends from and is integrally attached to the strain relief plate.

3. An electrical contact as recited in claim 1 wherein thickness of stock material of the electrical contact is greater than the width of the insulation displacement slot.

4. An electrical contact as recited in claim 1 wherein the wire receiving section has a strain relief plate which is spaced from and parallel to the insulation displacement plate.

5. An electrical contact as recited in claim 4 wherein a strain relief slot is provided in the strain relief plate, the strain relief slot is positioned in line with the insulation displacement slot such that a respective fine wire is terminated, the fine wire be positioned in both the insulation displacement slot and the strain relief slot.

6. An electrical contact as recited in claim 4 wherein curved bight portions are integrally attached to either end of the insulation displacement plates and the strain relief plates, the bight portions connect the plates together and maintain the spacing between the insulation displacement plate and the strain relief plate.

7. An electrical contact as recited in claim 1 wherein the locking member is a locking projection which extends outward from the first portion edge proximate the first slot portion.

8. An electrical contact as recited in claim 7 wherein a locking recess is provided on the second portion edge proximate the second slot portion, the locking recess is configured to conform to the shape of the locking projection and retains the locking projection therein.

9. An electrical contact for terminating fine wire, the contact comprising:

a wire receiving section having an insulation displacement plate and a strain relief plate, the insulation displacement plate and the strain relief plate are offset from each other and are essentially parallel, curved bight portions integrally attached to either end of the insulation displacement plates and the strain relief plates connect the plates together and maintain the spacing therebetween;

the insulation displacement plate has a first portion integrally attached to a first bight and a second portion integrally attached to a second bight, the first portion has a first free edge and the second portion has a second free edge, the first and second free edges are provided proximate each other to form a seam in the insulation displacement plate;

a first slot portion stamped from the first free edge and a second slot portion stamped from the second free edge cooperate with each other to form an insulation displacement slot;

a locking member proximate a base of the first and second slot portions, the locking member extending from the first portion and received by the second portion to maintain the first slot portion and the second slot portion in position relative to each other;

whereby the locking member is positioned to insure that the width of the insulation slot is maintained as the fine wires are received and terminated therein.

10. An electrical contact for terminating fine wire as recited in claim 9 wherein a strain relief slot is provided in the strain relief plate, the strain relief slot is positioned in line with the insulation displacement slot such that a respective fine wire is terminated, the fine wire be positioned in both the insulation displacement slot and the strain relief slot.

11. An electrical contact for terminating fine wire as recited in claim 9 wherein a mounting section extends from and is integrally attached to the strain relief plate.

12. An electrical contact for terminating fine wire as recited in claim 9 wherein thickness of stock material of the electrical contact is greater than the width of the insulation displacement slot.

13. An electrical contact for terminating fine wire as recited in claim 9 wherein a locking member is provided on the first portion and cooperates with the second portion to maintain the first free edge of the first portion adjacent to a second free edge of the second portion.

14. An electrical contact for terminating fine wire as recited in claim 13 wherein the locking member is a locking projection which extends outward from the first free edge proximate the first slot portion.

15. An electrical contact for terminating fine wire as recited in claim 14 wherein a locking recess is provided on the second free edge proximate the second slot portion, the locking recess is configured to conform to the shape of the locking projection and retains the locking projection therein.

* * * * *

UNITED STATES PATENT AND TRADEMARK OFFICE

CERTIFICATE OF CORRECTION

PATENT NO. : 6,419,518 B1
DATED : July 16, 2002
INVENTOR(S) : Larry E. Dittmann

It is certified that error appears in the above-identified patent and that said Letters Patent is hereby corrected as shown below:

Title page,
Item [12], change "Dittman" to -- Dittmann --;

Item [75], change "Larry E. Dittman" to -- Larry E. Dittmann --.

Signed and Sealed this

First Day of October, 2002

*Attest:*

*Attesting Officer*

JAMES E. ROGAN
*Director of the United States Patent and Trademark Office*